US006732461B2

(12) United States Patent
Slattery et al.

(10) Patent No.: US 6,732,461 B2
(45) Date of Patent: May 11, 2004

(54) INDEX TAB SYSTEM

(75) Inventors: Michael Slattery, Yonkers, NY (US); James Lynch, Point Lookout, NY (US); Rochelle Narup, Washington, MO (US)

(73) Assignee: Esselte Corporation, Melville, NY (US)

( * ) Notice: Subject to any disclaimer, the term of this patent is extended or adjusted under 35 U.S.C. 154(b) by 0 days.

(21) Appl. No.: 10/231,926

(22) Filed: Aug. 29, 2002

(65) Prior Publication Data

US 2004/0040193 A1 Mar. 4, 2004

(51) Int. Cl.[7] ..... B42F 13/00; B09F 23/10
(52) U.S. Cl. ..... 40/641; 40/79
(58) Field of Search ..... 40/641; 402/79

(56) References Cited

U.S. PATENT DOCUMENTS

| | | | | |
|---|---|---|---|---|
| RE28,969 E | | 9/1976 | Naito | 150/3 |
| 4,636,179 A | | 1/1987 | Gentile | 402/79 |
| 4,907,321 A | | 3/1990 | Williams | 24/587 |
| 5,447,334 A | | 9/1995 | Hartsock | 281/45 |
| 5,503,487 A | * | 4/1996 | Ong | 402/79 |
| 5,540,513 A | | 7/1996 | Wyant | 402/79 |
| 5,909,979 A | | 6/1999 | Winzen | 402/79 |
| 6,013,154 A | | 1/2000 | Thomas-Cote | 156/277 |
| 6,375,604 B1 | * | 4/2002 | Verhines | 493/325 |

FOREIGN PATENT DOCUMENTS

| | | | |
|---|---|---|---|
| WO | WO 9523069 A1 * | 8/1995 | B42F/21/02 |

* cited by examiner

*Primary Examiner*—Cassandra H. Davis
(74) *Attorney, Agent, or Firm*—Winston & Strawn LLP

(57) ABSTRACT

An index tab system for useful organization of articles in objects such as hanging folders, file folders, expandable folders, index cards, index dividers, notebooks, binders, and the like. The index tab system provides a plurality of index tab forming structures that can be affixed to any of the above mentioned objects for indexing the articles or the contents therein. The plurality of index tab forming structures includes interlocking structures for selective formation of tab cavities and selective placement of the tab members along the object.

24 Claims, 5 Drawing Sheets

INDEX TAB SYSTEM

FIELD OF INVENTION

The present invention relates to a new and useful index tab system for identification or informational purposes for file folders, shelf folders, expandable folders, index cards, index dividers, notebooks, binders, and the like, and to a filing system that utilizes the index tab system on an object used for organizing articles such as papers and printed documents.

BACKGROUND ART

It is common practice to provide tab members which extend from the edge of file folders, index dividers, hanging folders, binders, etc., at selected positions so that the folder, divider, or binder can be easily identifiable or to provide information regarding the contents of such file. For example, very well-known are the separable tabbing members for insertion into hanging folders. Such tabbing members have projected edges that must be inserted into the slots provided on the hanging folder. Since the tab member requires a tight fit it is sometimes difficult to insert the projected edges of tab member into the slots.

Additionally, when a series of tabbed hanging folders are desired, the user must make sure that the tabs are inserted so that they are staggered for easy viewing. This is often difficult since the user must correctly judge which slots to insert the tab member edges so that each tab is staggered when multiple hanging file folders are viewed.

Another difficulty with the separable tab member is that sometimes the enclosed space or tab cavity in which to place the informational insert is too tight and so it becomes a struggle to slide the insert into the tab space without creasing the tab member. It is just as difficult to remove the insert from the space once inserted. Often times a pen, toothpick, paperclip or other pointed object is needed to push the insert through so that it extends from the tab so that it can be grabbed and pulled out. Another problem with this type of tab member is sometimes the tab member dislodged from the folder slots and lost.

Another well-known tabbing system is that which is integral with the folder itself. One example of such a tabbing system is found in U.S. Pat. No. 5,447,334 to Hartsock. The tab taught by Hartsock is formed from the same paperboard blank as the folder. Thus, once information is written upon the tab, the folder cannot be reused. Also, when a series of folders are desirable it is important that the user obtains folders in which the integral tab member is positioned differently. Otherwise, the series of folders will have the tabs obstructing the view of other tabs that follow.

For both types of tabbing systems above, the manufacturer determines the amount of space provided on the tab. For example, the separable tab member has a defined space for an insert. Similarly, the Hartsock tab member has a defined amount of space for printing information. More importantly, these tabs are only capable of being used with the folder which is attached to the tab, i.e., Hartsock, or with folders that have slots in which the separable tab member may be inserted. Thus, the user is not free to use a different kind of folder, nor another object such as a binder or notebook, to hold information.

It is desirable for a tabbing system that is attachable to not only folders, but notebooks, binders, index dividers, etc. and one which provides tabs that easily accepts informational inserts, and tabs that do not become dislodged from predetermined slots provided on folders. Also desirable is a tabbing system in which the location of the informational tabs are determined by the user and the width of the tab is adjustable by the user to provide adequate space to accommodate informational inserts of different length. The present invention provides products that satisfy these desires.

SUMMARY OF THE INVENTION

The present invention relates to an index tab system that includes a strip of resilient plastic film which provides a plurality of tab-forming structures each of which is capable of providing an index tab member. The strip of plastic film is attachable to an object that is in need of such index tabs, and each forming tab structure includes first interlocking means for forming the index tab member.

Advantageously, each tab forming structures further includes second interlocking means for forming a tab cavity that is capable of receiving an informational insert. In this arrangement, the first interlocking means comprises releasably interlocking rib and groove elements that are positioned in spaced relation on the tab-forming structure and which are interlockable by folding the tab-forming structure upon itself and pressing the elements together to form the tab cavity. Also, the second interlocking means comprises releasably interlocking rib and groove elements that are positioned in spaced relation on the tab-forming structure and which are interlockable to hold the tab in an indexing position such that the informational insert is viewable.

The first interlocking means preferably comprises releasably interlocking rib and groove elements that are positioned in spaced relation on the tab-forming structure and which are interlockable by folding the tab-forming structure upon itself and pressing the elements together to form the tab cavity and the second interlocking means preferably comprises releasably interlocking rib and groove elements that are positioned in spaced relation on the tab-forming structure and which are interlockable to hold the tab in an indexing position such that the informational insert is viewable.

The tab-forming structure can be a single strip that the user can cut to form the desired lengths of tab members. It also can include a plurality of perforations or other discontinuities that can be broken or torn to define the length of the tabs. In a more preferred embodiment, the strip is precut so that at least three to five tab forming structures are provided along it. The individual tabs can be arranged in different positions along the strip by interlocking selected rib and groove elements together or separating interlocked rib and groove elements.

The plastic film preferably is a thermoplastic material such as polypropylene or PVC, and includes an adhesive for application of the plastic film to the object. If desired, the plastic strip may be colored and substantially transparent. At least some or all of the tab-forming structures can be substantially transparent but of different colors, or the tab-forming structures can be of a different color from the object to assist in visually identifying files. The informational inserts can be of different colors for this purpose.

The invention also relates to a filing system that includes an object for organizing articles and the index tab system described herein. Generally, the articles comprise paper and a file folder, a shelf folder, a hanging file folder, an index card, an expandable folder, a divider, a notebook or a binder.

The invention also a method of providing an index tab system which comprises providing a strip of resilient plastic film having one or more interlocking means thereon; cutting the strip to provide a plurality of tab forming members; adhering the strip to an object for organizing articles; and engaging one or more of the interlocking means to form index tab members.

DETAILED DESCRIPTION OF THE PREFERRED EMBODIMENTS

Figure 1:
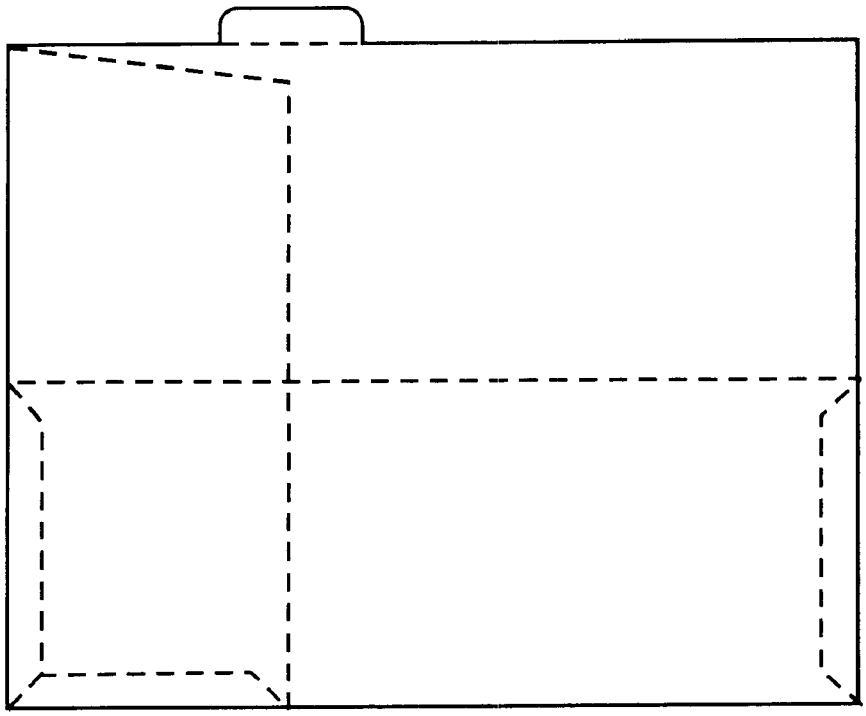
PRIOR ART Fig. 1
FIG. 1 is an illustration of a conventional tabbed file folder.

The index tab system can be used to tab or index objects such as file folder, a shelf folder, a hanging file folder, an index card, an expandable folder, a divider, a notebook or a binder. To attach the index tab system to a folder, notebook, divider, binder, hot melt adhesive may be used or alternatively, the plastic film may be provided with a pressure sensitive adhesive strip applied to one side of the plastic film so that it may be adhered to the edge of an object to be indexed or tabbed.

The preferred material for the plastic film is any thermoplastic material. Especially preferred from a cost and performance standpoint are polypropylene and PVC. However, as any skilled person in the art would know, any other resilient thermoplastic film may be used. The width and length of the plastic film may vary depending upon whether the object to be tabbed is a hanging folder, other folder, notebook, or index card. However, the preferable width is approximately 2.0625" when 5 tabs are provided and approximately 3.5" when 3 tabs are provided. Of course, if the tabbing of index cards is desirable a smaller width is desirable.

The tabs of the invention are reclosable. Thus, informational inserts may be easily inserted within the tab cavity and replacing such informational tabs is just as easy. The reclosable feature of the tab is provided by first interlocking means which allows the tab to be opened and closed easily. The interlocking means may comprise interlocking elements such as a male rib and a female rib integral with the tab member. The female rib may have a cross section of circular, elliptical or polygonal shape. The male rib has an axial body, the tope of which may be arrowhead-shaped in cross section and the width is a little greater than the opening of the female rib. The individual parts of the male and female ribs are arranged to have such thickness that they provide a fastening strength when the ribs are engaged. The interlocking means are releasable by drawing the interlocking elements apart.

The preferred interlocking means are the rib and groove arrangement described above, as this type material is already known and used to seal plastic sandwich bags. Here, the rib and groove arrangement presents a simple yet effective way to prepare tab members of the desired size and in the desired position. As to size, the tab member can be arranged to hold a standard business card, a conventional insert, or inserts or tabs of other sizes. In addition, any one or more of the tab-forming members can be arranged to be visible to the user to provide numerous variations of indexing, multiple index tabs can be used in one object, or a single tab can be used on sequentially filed objects in a staggered configuration for easy viewing.

The interlocking rib and groove elements are preferably positioned in a spaced relation on the tab forming structure and are interlockable by folding the tab forming structure upon itself and pressing the elements together to form a tab cavity. Additionally, second interlocking means are interlockable to hold the tab in an indexing position such that the informational insert is viewable. At least five tab-forming structures may be provided along the strip of plastic film and such tabs can be arranged in different positions along the strip by interlocking selected rib and groove elements together or separating interlocked rib and groove elements.

It is possible to provide tab members of adjustable width. This can be achieved by providing a single tab member that runs the length of the article organizing object. In one arrangement, the user can simply cut the tab member to the desired width to accommodate the insert. In a second embodiment, the tab member can be provided with a plurality of spaced perforations or other discontinuities that can be broken or torn to define the length of the tabs. In the preferred embodiment, a plurality of tabs are precut and provided with the article organizing object. For supporting inserts of greater width, a plurality adjacent tabs can be arranged depending upon which interlocking elements the user engages.

A preferred embodiment has a dual interlocking mechanism such that a first interlocking mechanism closes and opens the tab member and a second interlocking mechanism locks the tab member to the strip of plastic film such that the tab is held in an upright position.

Color coding of the tab forming members or even the inserts can be used for the most efficient organization of file materials. The plastic film and/or tab members may be colored and substantially transparent. The tab forming structures may be of different color than the object to be indexed. The informational inserts may be of a different color, or even some of the tab forming structures may be of different colors.

The tab members may be of any shape or size, including shapes such as hearts, diamonds, animals, balloons, or other shapes that are appealable especially to children.

These shapes can be achieved utilizing conventional die cutters.

Figure 2:
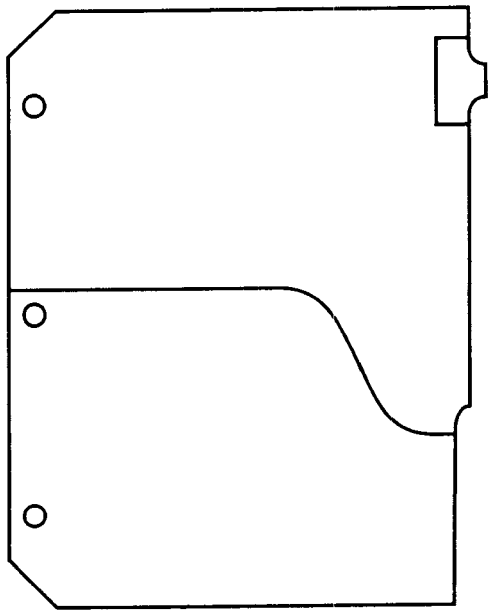
PRIOR ART Fig. 2
FIG. 2 is an illustration of a conventional tabbed index divider.

Turning now to the drawings, FIGS. 1 and 2 illustrates the typical folder with tabs. Specifically, FIG. 1 shows a file folder with a tab projecting from its edge and FIG. 2 shows an tabbed index divider commonly placed in binders.

Figure 3:
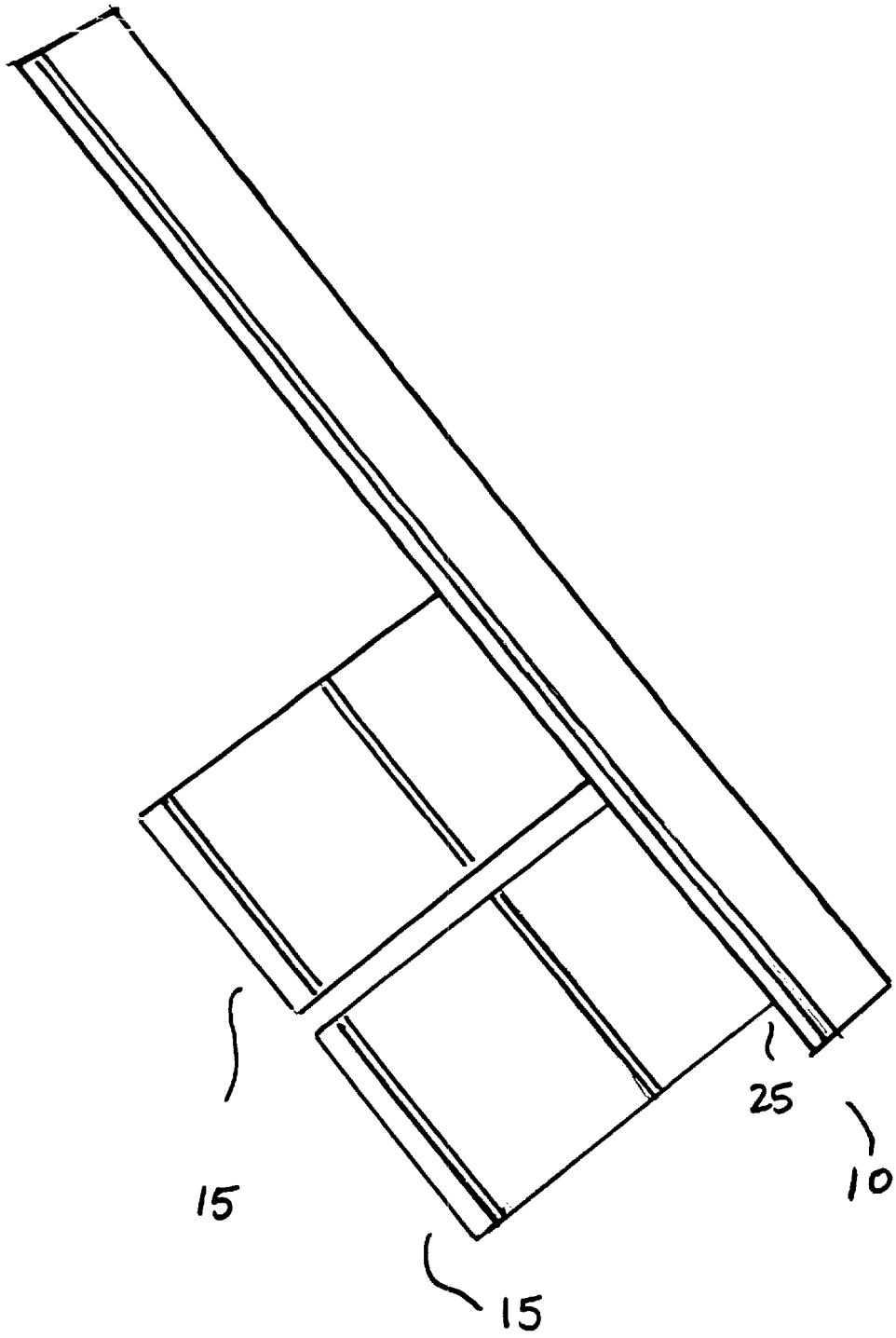
FIG. 3 illustrates the plastic film with die cut slots.

In contrast, FIG. 3 shows a strip of plastic film 10 constructed in accordance with the preferred embodiment is illustrated. The plastic film generally is a thermoplastic film that forms both the body and a plurality of integral tab structures 15.

In more detail, the plastic film body is cut from a sheet of lightweight plastic, preferably polypropylene material. Other plastic materials may be used as would be known by one skilled in the art. The width of the plastic film is preferably about 2.5 inches, however, depending on the object to be tabbed the width of the plastic film may be larger or smaller. For example, the width desirable for use with index cards would be smaller than that desirable for use with notebooks or hanging folders.

The plurality of tab structures is integrally cut from a portion of the plastic film body. The tab structures can be die cut while forming the plastic film or can be subsequently cut at a second cutting station. The desired width of the tab structures depends upon the number of tabs desired and the width of the object. When 5 tabs are desired and the object is a 8.5.×1" hanging file folder, the width of each tab is approximately 2.0625" and they are separated by a space of ⅛". When 3 tabs are provided, each is approximately 3.5" wide.

Figure 5:
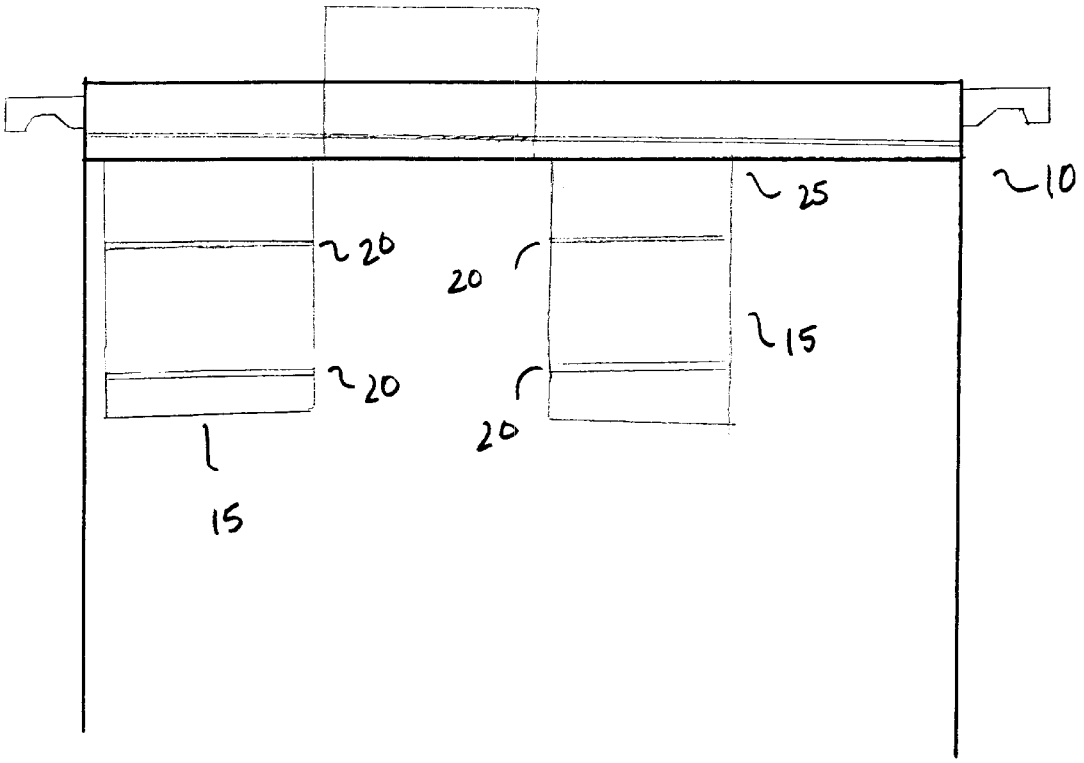
FIG. 5 illustrates the tabbing system attached to a hanging folder.
Figure 3:
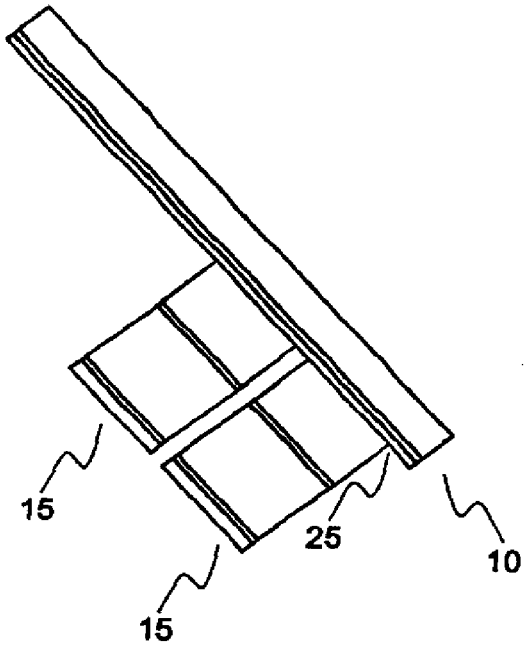
Figure 4:
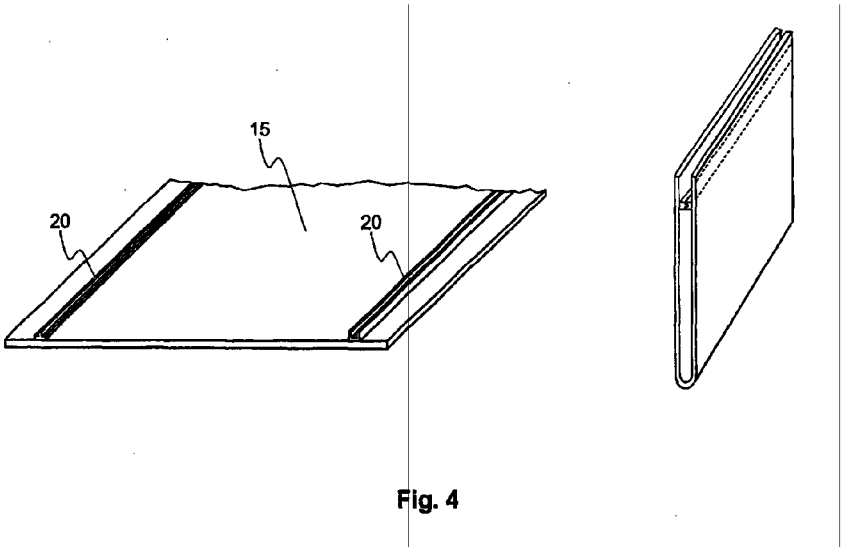
Figure 5:
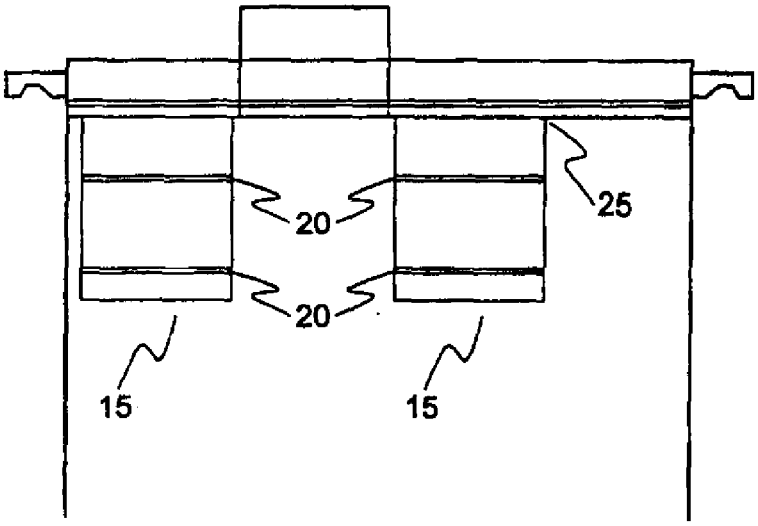

As illustrated in FIG. 5, the strip of plastic film is attachable to the edge of a folder or other object to be tabbed by hot melt adhesive. Alternatively, the plastic film may be provided with pressure sensitive adhesive to attach to the edge of a folder or other object to be tabbed.

Figure 4:
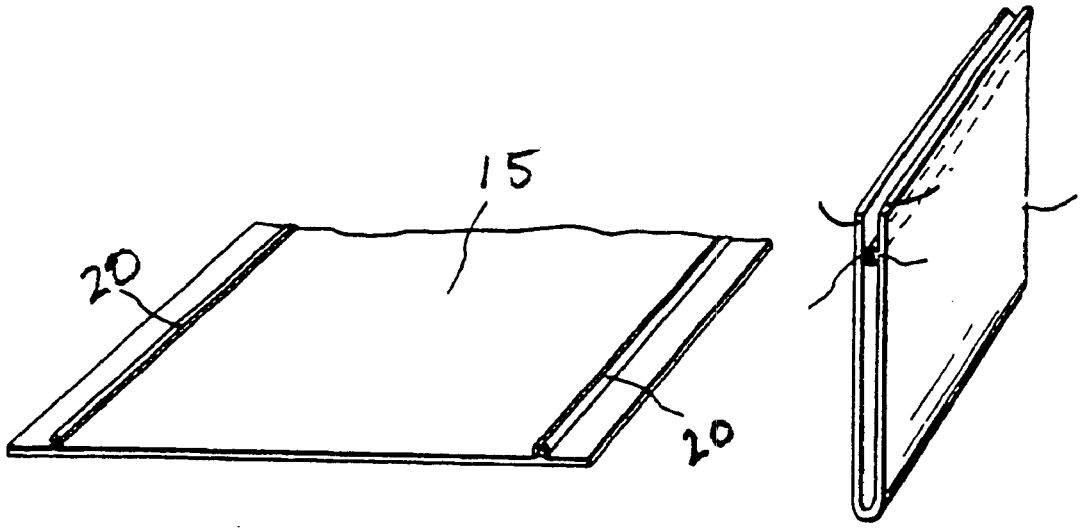
FIG. 4 illustrates the tab and interlocking means.

As illustrated in FIG. 4, the tab structure presents a flat surface having interlocking means 20. As illustrated in FIG. 3, one side of the tab is not cut from the plastic film body so that it remains attached to the folder body along a first fold line 25 and can pivot about the fold line.

The interlocking means can vary depending upon the type of object indexed. For example, an adhesive can be applied to the strip, if necessary, along with a removable cover film so that the adhesive does not adhere to other portions of the object before the tab members are formed. The adhesive may also be a weak pressure sensitive adhesive so that it can be engaged to form the tab member and disengaged when the tab member is not longer desired or needed.

Snaps or other releasably engageable elements can be used as the interlocking means, as can lugs with pins for maintaining the lugs together. Thus, the term "interlocking means" can also refer to any known male-female or tongue-groove arrangement of interlocking members.

The interlocking means preferably includes interlocking elements such as a male rib and a female rib. The male rib engages the female rib with the application of pressure. The tab structure preferably has interlocking elements such that when the interlocking elements are engaged the tab structure forms an enclosed cavity or internal space in which an informational insert may be placed. Additionally, the tab structure preferably also has interlocking elements such that when the tab structure is pivoted about the fold line, the tab structure may be locked to the plastic tab by second interlocking elements such that the tab structure is held in an upright position which extends from the edge of the folder or object to be tabbed for identification purposes. For example the tab structure can be positioned so that it extends from a hanging folder or file folder for easy identification.

Any unused tab structures may be positioned so that such tab structures do not pivot about the fold line and are not locked in an upright position, rather the unused tab structures lie flat relative to the plastic film and folder. In this way, the tab is hidden from view. Thus, a user may decide to use only one of the plurality of tab structures for informational purposes.

If such is the case, the user would lock the tab into an upright position using the interlocking means while the remaining tab structures would be positioned flat relative to the plastic film and folder such that they are hidden from view. Alternatively, the tab structure may include tear lines, i.e., perforations or score lines, so that any unused tabs may be torn away from the plastic film and discarded to provide more room in the folder or object for organizing or storing articles therein.

The tab structure may also provide a plurality of interlocking elements such that the user may adjust or determine the desirable length of the tab structure so that it may accommodate a larger informational insert such as a business card, or the like.

The tab structure is preferably rectangular shaped. However, as those skilled in the art will appreciate, the tabs can be cut in a variety of shapes and sizes. For example, to appeal to children, the tabs can be formed in the shape of animals, or flowers. Additionally, the tab structure may be sized and shaped to receive a business logo for marketing purposes.

In use the plastic film with integral tab structures is attached to the edge of an object to be tabbed. By way of example and without intending to be limiting, the strip of plastic film with integral tab structures is affixed to the edge of a hanging folder by application of hot melt adhesive. The tab structures may be closed by placing the interlocking elements in a face-to-face orientation and applying pressure thereto so that the male rib and the female rib elements become engaged. An informational insert may be slid into the cavity or internal space created when the tab structure is interlocked. Although the insert may be placed on the tab structure flat surface before the interlocking elements are engaged. The user may then lock the tab structure in an upright position by locking a second interlocking mechanism. The second interlocking mechanism comprises a male or female rib located on the side of the tab member and the corresponding female or male rib on the strip of plastic film. Any unused tab structures may be torn off the strip of plastic film and discarded or simply be left unengaged in which the tab structure will remain flat against the folder.

Although the invention has been described with reference to certain embodiments, it is noted that equivalents may be employed and substitutions made herein without departing from the scope of the invention as recited in the claims. Additionally, as those skilled in the art will appreciate, the length, width and height of the tab may be varied to suit a variety of applications, as well as the type of plastic film.

What is claimed is:

1. An index tab system comprising a strip of resilient plastic film providing a plurality of tab-forming structures each of which is capable of providing an index tab member, wherein said strip of plastic film is attachable to an object that is in need of such index tabs wherein each said tab forming tab structure includes first interlocking means for forming the index tab member, and second interlocking means for forming a tab cavity that is capable of receiving an informational insert.

2. The index tab system of claim 1 wherein the second interlocking means comprises releasably interlocking rib and groove elements that are positioned in spaced relation on the tab-forming structure and which are interlockable by folding the tab-forming structure upon itself and pressing the elements together to form the tab cavity.

3. The index tab system of claim 1 wherein the first interlocking means comprises releasably interlocking rib and groove elements that are positioned in spaced relation on the tab-forming structure and which are interlockable to hold the index tab member in an indexing position such that the informational insert is viewable.

4. The tab forming structure of claim 1, wherein the second interlocking means comprises releasably interlocking rib and groove elements that are positioned in spaced relation on the tab-forming structure and which are interlockable by folding the tab-forming structure upon itself and pressing the elements together to form the tab cavity and further wherein the tab forming structure comprises first interlocking means comprising releasably interlocking rib and groove elements that are positioned in spaced relation on the tab-forming structure and which are interlockable to hold the index tab member in an indexing position such that an informational insert placed in the tab cavity is viewable.

5. The index tab system of claim 4 wherein at least five tab forming structures are provided along the strip and where index tabs members can be arranged in different positions along the strip by interlocking selected rib and groove elements together or separating interlocked rib and groove elements.

6. By The index tab system of claim 1 wherein the plastic film comprises a thermoplastic material.

7. The index tab of claim 1 wherein one side of the plastic film includes an adhesive for application of the plastic film to the object.

8. The index tab system of claim 1 wherein the plastic strip is colored and substantially transparent.

9. The index tab system of claim 1 wherein tab-forming structures are of a different color from the object.

10. The index tab system of claim 1 wherein the tab-forming structures are clear and transparent and the informational inserts are of different colors.

11. A filing system comprising an object for organizing articles and the index tab system of claim 1.

12. The filing system of claim 11 wherein the articles comprise paper and a file folder, a shelf folder, a hanging file folder, an index card, an expandable folder, a divider, a notebook or a binder.

13. The filing system of claim 11 wherein the object for organizing articles is a different color than the plastic film of the index tab.

14. The filing system of claim 11 wherein the plastic film comprises a thermoplastic material and is applied to the object for organizing articles by an adhesive.

15. The filing system of claim 11 wherein the plastic film is polypropylene or PVC.

16. A method of providing an index tab system which comprises providing a strip of resilient plastic film having one or more interlocking means thereon and one or a plurality of tab forming members;

adhering the strip to an object for organizing articles;

engaging the one or more of the interlocking means to form one or more index tab members; and engaging the one or more interlocking means to form one or more tab cavities that are capable of receiving an informational insert therein.

17. The method of claim 16 which further comprises cutting the strip to provide a plurality of at least 3 tab forming members.

18. The method of claim 17 which further comprises providing five tab forming members along the strip so that index tab member can be arranged in different positions by engaging or separating the interlocking means.

19. The method of claim 16 wherein the plastic film comprises a thermoplastic material.

20. The method of claim 16 wherein the one or more interlocking means is engaged to hold the index tab member in an indexing position such that the informational insert is visible.

21. The method of claim 16 wherein the articles to be organized include paper and the object is a file folder, a shelf folder, a hanging file folder, an index card, an expandable folder, a divider, a notebook or a binder.

22. The method of claim 16 wherein the plastic strip is colored and substantially transparent.

23. The method of claim 16 wherein the tab-forming structures are of a different color from the object.

24. The method of claim 16 wherein the tab-forming structures are transparent and clear and the informational inserts placed in the tab cavity are of different colors.

* * * * *

UNITED STATES PATENT AND TRADEMARK OFFICE

CERTIFICATE OF CORRECTION

PATENT NO. : 6,732,461 B2
DATED : May 11, 2004
INVENTOR(S) : Slattery et al.

It is certified that error appears in the above-identified patent and that said Letters Patent is hereby corrected as shown below:

Title page,
Replace the figure with the following Fig. 3:

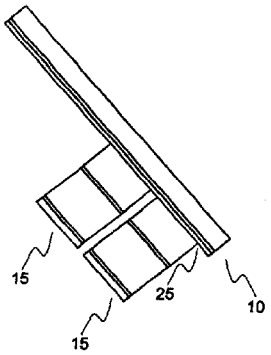

Fig. 3

Drawings,
Replace Figs. 3-5 with the following figures:

Column 7,
Line 1, change “index tabs members” to -- index tab members --.
Line 5, before “The index tab system of claim 1”, delete “By”.

Signed and Sealed this

Seventeenth Day of August, 2004

JON W. DUDAS
*Acting Director of the United States Patent and Trademark Office*